US010934054B1

(12) United States Patent
Garrison, Jr.

(10) Patent No.: US 10,934,054 B1
(45) Date of Patent: Mar. 2, 2021

(54) PACKAGING OF FLOWABLE PRODUCTS

(71) Applicant: Joseph Richard Garrison, Jr., Orange, CA (US)

(72) Inventor: Joseph Richard Garrison, Jr., Orange, CA (US)

(73) Assignee: Joseph Richard Garrison, Jr., Orange, CA (US)

( * ) Notice: Subject to any disclaimer, the term of this patent is extended or adjusted under 35 U.S.C. 154(b) by 655 days.

(21) Appl. No.: 14/580,944

(22) Filed: Dec. 23, 2014

Related U.S. Application Data

(60) Provisional application No. 61/920,687, filed on Dec. 24, 2013.

(51) Int. Cl.
*B65D 21/02* (2006.01)
*B65D 25/28* (2006.01)
*B65D 47/04* (2006.01)

(52) U.S. Cl.
CPC ..... *B65D 21/0204* (2013.01); *B65D 21/0205* (2013.01); *B65D 25/28* (2013.01); *B65D 47/04* (2013.01)

(58) Field of Classification Search
CPC .... B65D 21/0205; B65D 25/28; B65D 47/04; B65D 21/0204
USPC ..... 220/23.4
See application file for complete search history.

(56) References Cited

U.S. PATENT DOCUMENTS 3,933,268 A * 1/1976 Buske ..... B65D 21/0202 206/504
3,994,408 A * 11/1976 Belitzky ..... B65D 21/0204 215/10
4,486,839 A * 12/1984 Mazur ..... B60T 8/1705 246/182 B
4,572,413 A * 2/1986 Vogt ..... B65D 17/06 222/528
4,573,595 A * 3/1986 Mednis ..... B65D 21/0231 206/509
4,708,253 A * 11/1987 Mednis ..... B65D 21/0202 206/504
D361,262 S * 8/1995 Lusker ..... D9/561
D449,778 S * 10/2001 Legoupil ..... D9/523
D459,651 S * 7/2002 Gagnon ..... D9/517
6,772,898 B1 * 8/2004 Florino ..... B65D 21/0204 220/23.4
7,516,860 B1 * 4/2009 Fenton ..... B65D 21/0204 215/10
D690,990 S * 10/2013 Boggs ..... D7/397
2013/0037426 A1 * 2/2013 Shen ..... B65D 21/0204 206/216
2013/0134161 A1 * 5/2013 Fogel ..... B65D 21/0209 220/23.83

(Continued)

*Primary Examiner* — Anthony D Stashick
*Assistant Examiner* — Raven Collins
(74) *Attorney, Agent, or Firm* — Knobbe Martens Olson & Bear LLP

(57) ABSTRACT

A container system has a plurality of separable interlocking vessels. Each of the vessels defines a separately sealed volume. Each of the vessels has an outlet. One of the plurality of the vessels is an upper vessel and one of the plurality of vessels is a lower vessel. The outlet of the upper vessel is the lowermost portion of the upper vessel and is disposed to one side of the upper vessel. The outlet of the lower vessel is the uppermost portion of the lower vessel and is disposed to one side of the lower vessel.

20 Claims, 9 Drawing Sheets

(56) References Cited

U.S. PATENT DOCUMENTS

| | | | | |
|---|---|---|---|---|
| 2014/0035753 | A1* | 2/2014 | Cooke | G08B 17/113<br>340/628 |
| 2016/0272368 | A1* | 9/2016 | Buck, III | B65D 21/0204 |

* cited by examiner

PACKAGING OF FLOWABLE PRODUCTS

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND OF THE INVENTION

Field of the Invention

The present invention generally relates to bulk storage containers and packaging of flowable products. More particularly, the present invention relates to such containers and packaging used for transporting, storing, dispensing and otherwise handling flowable products.

Description of the Related Art

U.S. Pat. No. 6,158,623, which is hereby incorporated by reference in its entirety, discloses a container for handling bulk flowable products. The container resolved several issues encountered in the transporting, storing, dispensing and otherwise handling of flowable products. Nevertheless, there remains room for further improvement for such containers.

SUMMARY OF THE INVENTION

It has been found that transporting, storing, and dispensing dry products is fraught with difficulties. For example, the containers or packaging often rip or tear, which can cause spillage and a loss of product. In addition, in some situations, inferior packaging can cause deterioration or spoilage of the content. Applicants have found that some cardboard containers can absorb moisture, which can reduce the shelf life of the product contained within the container, for example. Moreover, where a cardboard container absorbs moisture, the integrity of the packaging can be compromised and the content can be more likely to spill or spoil. Further, containers lacking handles have been discovered to be difficult to manipulate due to the size and weight of the contents. Thus, certain features, aspects and advantages of some embodiments of the present invention involve providing a container assembly that is formed of substantially more durable materials.

Certain features, aspects and advantages of some embodiments of the present invention involve providing a container assembly that can be sealed against moisture and air contamination. The container assembly keeps the products securely container, fresh and dry. Advantageously, in some configurations, the container assembly keeps one half of the package completely sealed and fresh until the first half of the product is used. Further, in some configurations, due to the container assembly configuration, the product can be readily dispensed while reducing or eliminating the likelihood of spillage of the product.

In some configurations, the container assembly comprises a separable container assembly such that half of the weight of the container assembly can be handled at a time, if desired. In addition, in some configurations, the container assembly comprises a handle on each of the separable container assemblies to assist with moving of the container assembly. The handle or handles are ergonomic and allow one to store, transport, and dispense product from within the container assembly more efficiently, more effectively and with little to no loss of the product.

Further, in some configurations, the container assembly provides a marked improvement of bulk storage in bags or the like due to the smaller footprint provided by the container assembly relative to the bags or the like.

In some configurations, a container system comprises a plurality of separable vessels that are connectable together. Each of the vessels defines a separately sealed volume. Each of the vessels comprises an outlet. One of the plurality of the vessels is an upper vessel and one of the plurality of vessels is a lower vessel. The outlet of the upper vessel is the lowermost portion of the upper vessel and is disposed to one side of the upper vessel. The outlet of the lower vessel is the uppermost portion of the lower vessel and is disposed to one side of the lower vessel.

In some configurations, the outlet of the upper vessel is recessed inward relative to the one side of the upper vessel. In some such configurations, the outlet of the upper vessel projects further outward relative an adjacent side of the lower vessel.

In some configurations, the upper vessel comprises a dispensing angle that is greater than a product flow angle. In some such configurations, the dispensing angle is 60 degrees. In some such configurations, the product flow angle is 45 degrees.

In some configurations, the upper vessel and the lower vessel are connected together using an adhesive.

In some configurations, the upper vessel and the lower vessel are connected together using mating interlocking structures. In some such configurations, the mating interlocking structures comprise a slide portion and a rail portion with the rail portion being received within the slide portion. In some such configurations, each of the upper vessel and the lower vessel comprises both of a rail portion and a slide portion. In some such configurations, the slide portion is closer to the outlet than the rail portion. In some such configurations, the slide portion is defined by a shoulder formed on an outlet protrusion. In some such configurations, the rail portion is defined by an embossment formed on a lip of an outlet receiving recess.

In some configurations, the upper vessel comprises both an outlet protrusion and an outlet receiving recess and the lower vessel comprises both an outlet protrusion and an outlet receiving recess. In some such configurations, the outlet protrusion of the upper vessel is received within the outlet receiving recess of the lower vessel and the outlet protrusion of the lower vessel is received within the outlet receiving recess of the upper vessel when the upper vessel and the lower vessel are connected together.

In some configurations, each of the upper vessel and the lower vessel comprises a handle.

In some configurations, the outlet of the upper vessel comprises a dispensing assembly and the outlet of the lower vessel comprises a dispensing assembly with each of the dispensing assemblies comprising a removable cap.

In some configurations, each of the vessels is formed by blow-molding.

In some configurations, the upper vessel and the lower vessel have identical constructions. In some configurations, two or more vessels can have minor differences between them. In some configurations, two or more vessels can have different details from each other. In some configurations, two or more vessels can have different volumes from each other. In some configurations, two or more vessels can receive different products relative to each other. In some configurations, two or more vessels can receive the same products relative to each other.

In some configurations, the upper vessel and the lower vessel are configured to have the same contained volumes.

The systems, methods and devices described herein have innovative aspects, no single one of which is indispensable or solely responsible for their desirable attributes. Without limiting the scope of the claims, some of the advantageous features will now be summarized.

BRIEF DESCRIPTION OF THE DRAWINGS

Throughout the drawings, reference numbers can be reused to indicate general correspondence between reference elements. The drawings are provided to illustrate example embodiments described herein and are not intended to limit the scope of the disclosure.

DETAILED DESCRIPTION OF THE PREFERRED EMBODIMENTS

Figure 1:
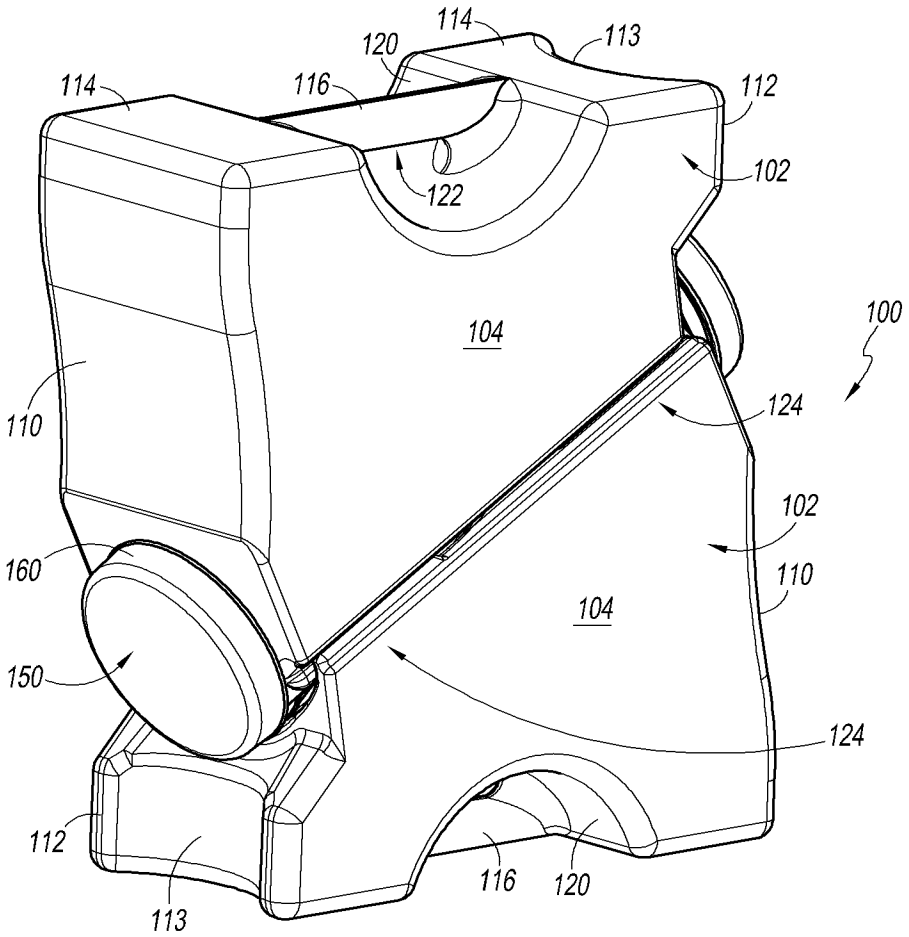
FIG. 1 is a perspective view of a container system that is arranged and configured in accordance with certain features, aspects and advantages of the present invention.

With reference now to FIG. 1, a container system 100 is illustrated therein. The container system 100 has particular utility with liquid or solid flowable products. In some configurations, the container system has particular utility with respect to dry granular, pebble, or small (e.g., 0.5 inch) diameter spheres or cubes or any other dry product. In some configurations, the container system can be configured to dispense water or other fluids.

The container system 100 advantageously comprises a plurality of vessels 102 that connect together to define the illustrated container system 100. In the illustrated container system 100, there are two vessels 102. In some configurations, there can be three, four or more vessels. Other configurations are possible keeping in mind a desire to have separately sealable volumes that are sealed and isolated from each other to improve product shelf life even while beginning to dispense product. The vessels can be formed in any suitable manner and from any suitable material. In some configurations, the vessels 102 are formed by blow molding and the vessels 102 can be formed of plastic. In some configurations, the vessels 102 can be formed using other techniques, including injection molding, thermoforming or the like.

The illustrated container system 100 comprises two separate but interconnected vessels 102. In other words, the two vessels 102 are formed separately and each of the two vessels 102 defines a self-contained component that can be removed from the other of the two vessels 102, if desired. In some configurations, the two vessels 102 can be removably connected such that the two vessels can be easily separated. In some configurations, the two vessels 102 can be separately formed and permanently or semi-permanently secured together such that destruction of one or both of the vessels will result from removal or attempted removal of one of the vessels 102 from the other. For example, the two vessels can have mechanical interlocks or can be thermally welded together.

Figure 2:
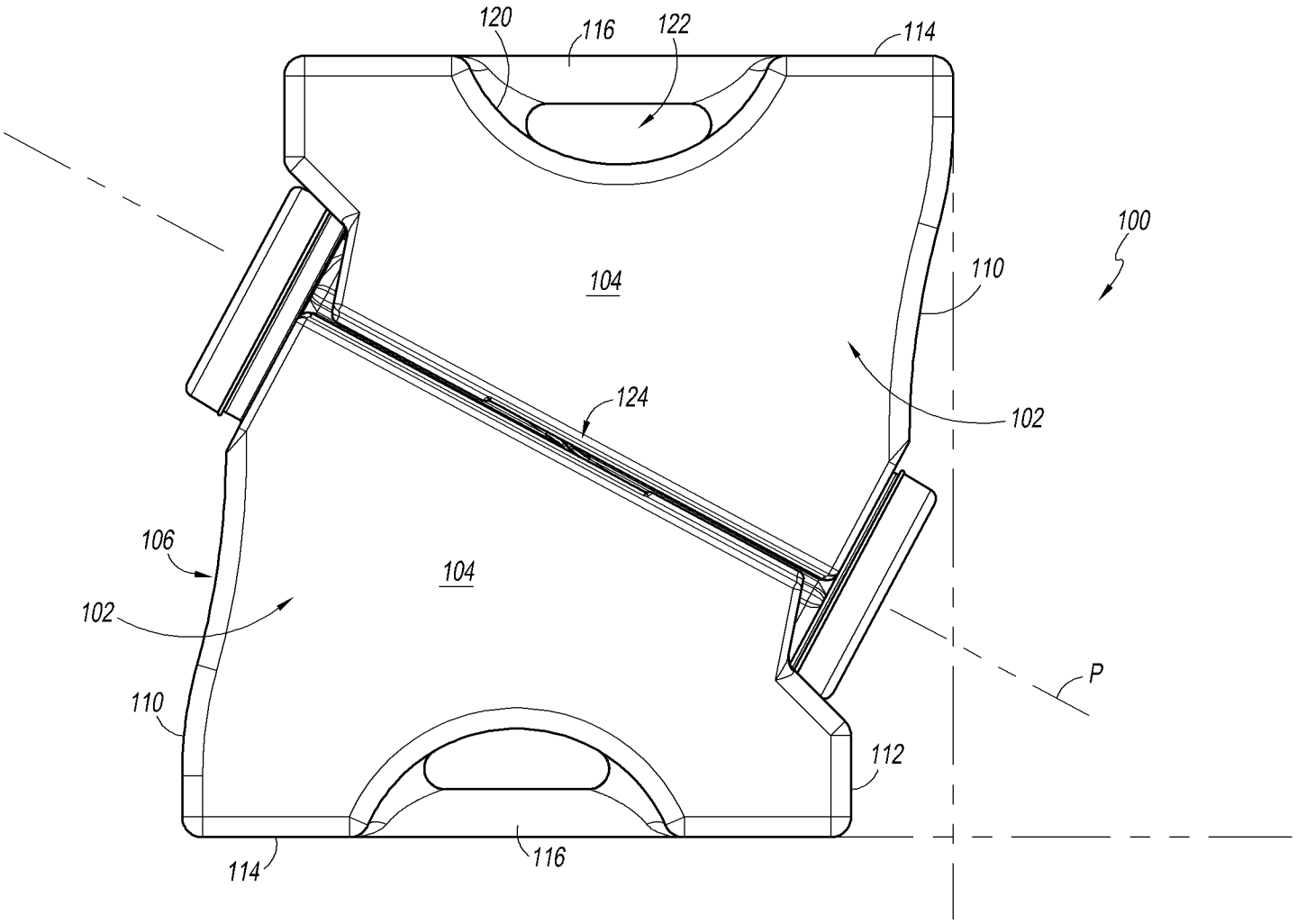
FIG. 2 is a side view of the container system of FIG. 1.

With reference to the side view of FIG. 2 of the container system 100, the vessels 102 can have any suitable configuration. In the illustrated configuration, the vessels 102 are identical to each other. By forming the container system 100 with a plurality of identical vessels 102, manufacturing can be simplified. In other words, having the container system 100 formed by a plurality of identical vessels 102 allows only a single vessel shape to be manufactured and stocked.

The illustrated vessels 102 comprise multiwall sealable containers. The vessels 102 can have any suitable shape keeping in mind a desire to have separately sealable containers with outlets that are positioned vertically higher than the surface upon which the container assembly will rest such that product can be gravity-dispensed without lifting any of the vessels 102. The illustrated vessels 102 comprise two generally parallel side walls 104. The side walls 104 can be joined by peripheral walls 106. In the illustrated configuration, the peripheral walls 106 can comprise a first generally vertical wall 110, a second generally vertical wall 112 and an interconnecting wall 114. The first generally vertical wall 110 is longer than the second generally vertical wall 112.

The second generally vertical wall 112 helps the lower vessel 102 act as a riser for the upper vessel 102. In some configurations, the second generally vertical wall 112 includes a recess 113 (see FIG. 1). The recess 113 receives serving or cooking utensils (e.g., bowls, cups, or the like). The recess is positioned generally below the dispensing outlet of the supported vessel 102.

In the illustrated configuration, the first and second generally vertical walls 110, 112 extend generally parallel but include styling. In other words, the surfaces defined by the walls 110, 112 have a gentle wave shape to improve aesthetic appearance. In some configurations, the gentle wave shape is sufficiently large to recess an outlet, which assists with protecting dispensing components during shipping. However, any suitable shape can be used to provide this advantage and the gentle wave has adds a distinctly aesthetic appearance to the container assembly 100.

The interconnecting wall 114 defines both an upper surface and a lower surface of the illustrated container system 100. While the illustrated interconnecting wall 114 is generally planar, the interconnecting wall can have any suitable shape keeping in mind that the interconnecting wall 114 can define the supporting surface of the container system 100. For example, the interconnecting wall 114 can include embossments or the like to define feet that raise at least a portion of the balance of the interconnecting wall 114 above the level of the shelf or other support surface upon which the container system 100 may be placed.

In addition, the interconnecting wall 114 may include features to assist with handling the container system 100. In the illustrated configuration, the interconnecting wall 114 is interrupted by a handle 116. In some configurations, the handle 116 can be positioned along other surfaces of the container system 100. Positioning the handle 116 along the interconnecting wall 114, however, positions the handle 116 in a location that will be less likely to impact dispensing of product from within the vessels 102.

The handle 116 can be integrally formed with the vessel 102 or separately formed and secured to the balance of the vessel 102. Manufacturing can be simplified by integrally forming the handle 116 with the vessel 102. As illustrated, a recess 120 can be defined within the vessel 102 adjacent to the handle 116. The recess 120 in the illustrated configuration is formed along the interconnecting surface 114 and also is formed by the sidewalls 104. In the illustrated configuration, the recess 120 has an arcuate shape for styling and aesthetic purposes but any shape of recess can be used.

In the illustrated configuration, an opening 122 also is formed adjacent to the handle 116. The opening 122 facilitates the gripping of the handle 116 by more than the finger tips but the opening 122 can be omitted in some configurations. In such configurations, for example, the handle 116 can be formed by grooves or recesses or the like. Other handle or grasping structure configurations also can be used keeping in mind a desire for facilitating the handling of the container system 100 and/or vessel 102.

In the illustrated configuration, a parting plane P is defined between the two vessels 102. The parting plane P is a transverse plane that slopes downward between two ends of the container system. The parting plane P is the plane along which the two vessels 102 are separated and, in some configurations, physically separable.

The parting plane P in the illustrated configuration can pass through interlocking structures 124. The interlocking structures 124 can have any suitable configuration keeping in mind a general desire to limit relative movement between the vessels 102 along the parting plane P once the two vessels 102 have been connected together. In some configurations, the interlocking structures can have any suitable configuration keeping in mind a general desire to limit relative movement along the parting plane and normal to the parting plane once the two vessels 102 have been connected together.

Figure 3:
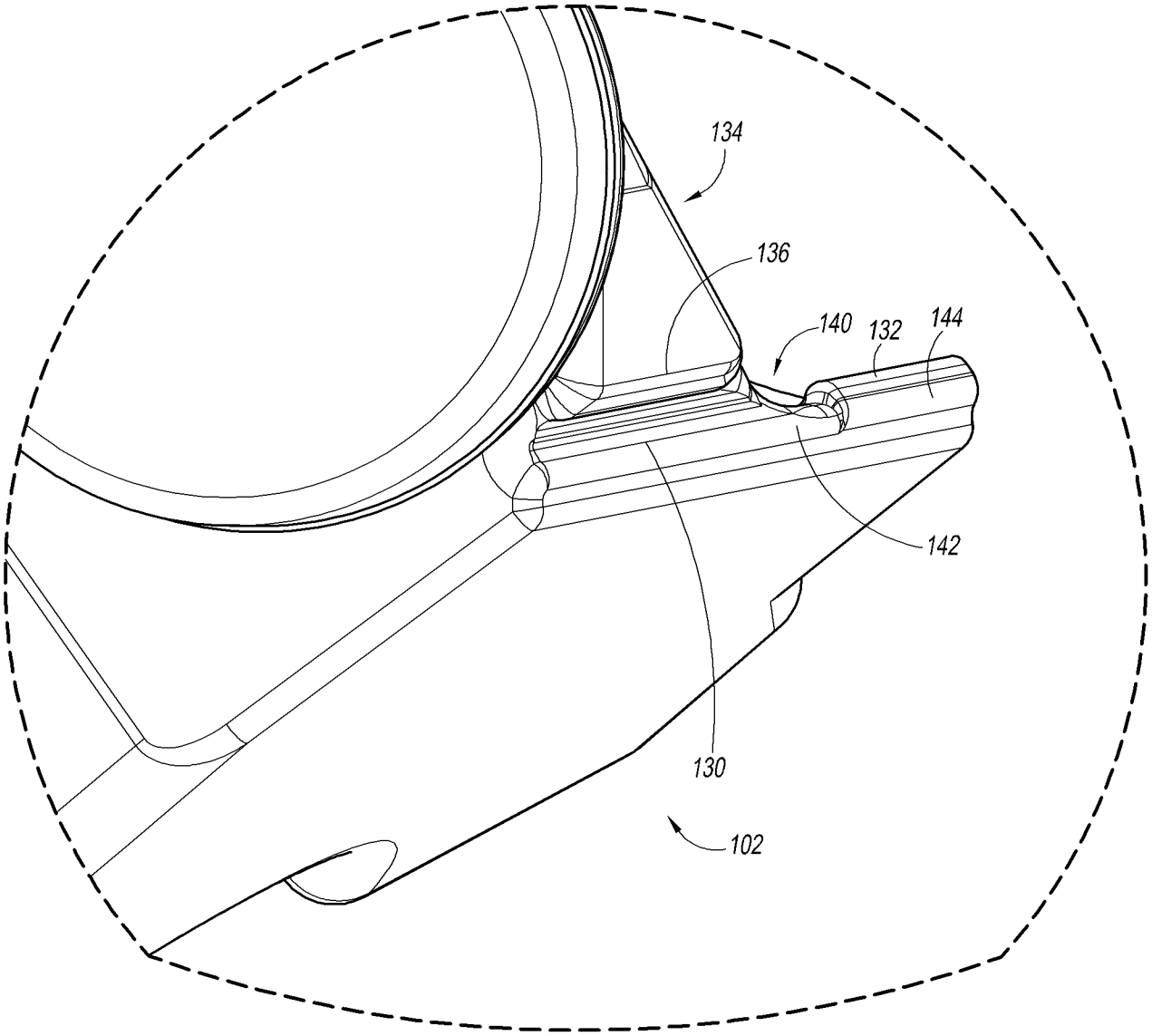
FIG. 3 is an enlarged perspective view of a portion of a vessel used in the container system of FIG. 1.

With reference to FIG. 3, the interlocking structures 124 of the illustrated configuration are shown in more detail. As illustrated, each of the vessels 102 comprises a slide portion 130 and a rail portion 132. The slide portion 130 is a female portion arranged, sized and configured to receive the rail portion 132 of the other vessel 102 while the rail portion 132 is a male portion arranged, sized and configured to be received within the slide portion of the other vessel 102.

Figure 4:
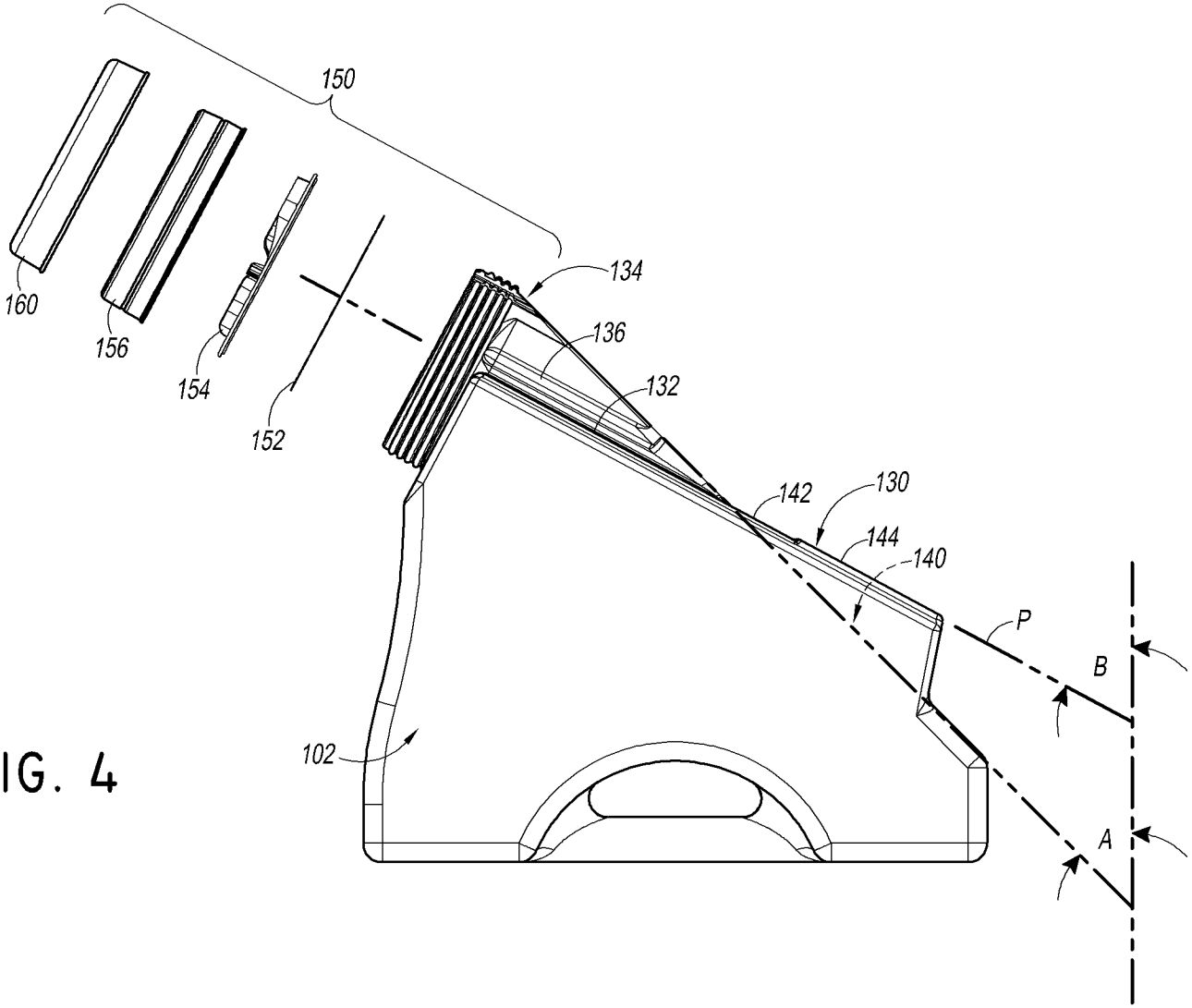
FIG. 4 is an exploded side view of the vessel used in the container system of FIG. 1.

With reference to FIG. 4, the vessel 102 comprises an outlet protrusion 134. The outlet protrusion 134 extends upward (downward when in the dispensing position) beyond parting plane P. When positioned for dispensing, the outlet protrusion 134 ensures that the outlet is the lowest portion of the illustrated vessel 102. Moreover, the outlet protrusion 134 comprises a cylindrical shape such that the outlet protrusion acts to direct product to the outlet. Such a configuration enhances the ability to fully dispense the product contained within the vessel 102.

In the illustrated configuration, the outlet protrusion 134 comprises a shoulder 136. The slide portion 130 is defined at least in part by the shoulder 136. Thus, in the illustrated configuration, the shoulder 136 has a length that is no longer than the length of the portion of the outlet protrusion 134 that is located above the parting plane P. Other lengths of the shoulder 136 also are possible keeping in mind a desire to allow the rail portion 132 and the slide portion 130 to interlock.

Also shown in FIG. 4 is an outlet receiving recess 140. The outlet receiving recess 140 can be sized and positioned to accommodate the outlet protrusion 134 when two vessels 102 are brought together. In the illustrated configuration, the rail portion 132 is positioned along a lip 142 that extends along the parting plane P adjacent to the outlet receiving recess 140. The rail portion 132 can be defined as an embossment 144. The embossment 144 can protrude from the lip 142. In some configurations, the embossment 144 has a length that is no longer than the length of the portion of the lip 142 that is above the outlet receiving recess 140. Other lengths of the embossment 144 also are possible keeping in mind the desire to allow the rail portion 132 and the slide portion 130 to interlock.

In use, an end of the embossment 144 can be brought into alignment with an end of the recess defined by the shoulder 136 and then the two vessels 102 can be slide along the parting plane P such that the embossment 144 is received within the recess defined by the shoulder 136. Structures can be provided to limit the extent of relative movement along the parting plane P of the two vessels. In other words, it is possible to create a snap-fit stop or the like such that the two vessels 102 can be secured in a desired position relative to each other.

In the illustrated configuration, the outlet protrusion 134 terminates at a dispensing assembly 150. Any suitable dispensing assembly 150 can be used keeping in mind a desire to maintain control of the dispensing. For example, the dispensing assembly 150 can comprise a dial with a window for dispensing, a limited rotation dial, a vertical slide (e.g., a gate), a hose spout, a pivoting ramp spout, a liquid valve or the like. In addition, the dispensing assembly 150 can have any number of components to carry out desired functions. The components of the dispensing assembly 150 generally can be formed by injection molding plastic or the like.

With reference to FIG. 4, the illustrated dispensing assembly 150 comprises a ring 152, a spout 154, a retaining ring 156 and a cap 160. In some configurations, the dispensing assembly 150 also can comprise a seal that can be secured to an opening 162 of the dispensing assembly 150 (e.g., over the end of the retaining ring 150 or over the surface at the end of the outlet protrusion 134. The seal can be used to guard against contamination, loss of product, or the like.

Figure 5:
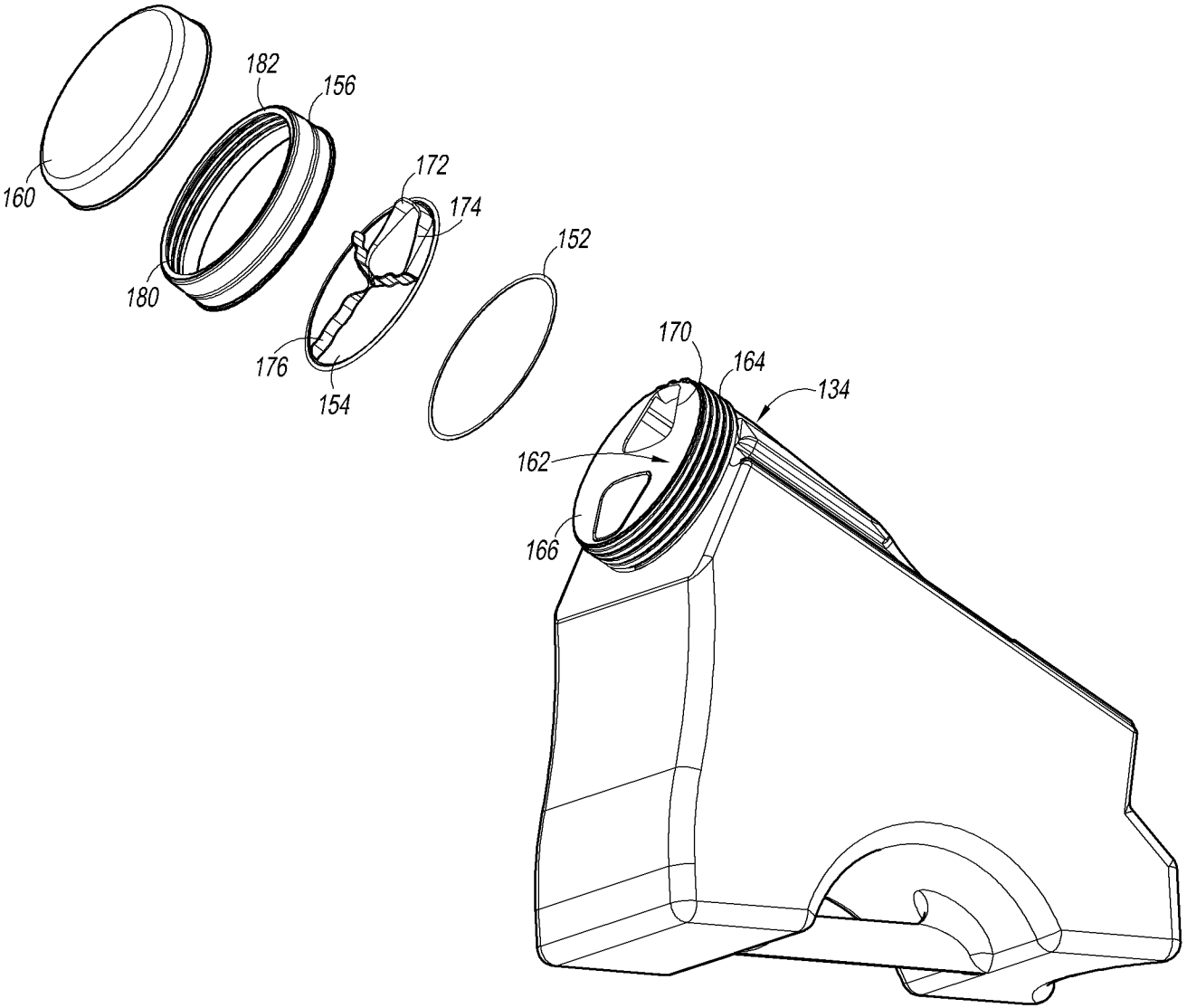
FIG. 5 is an exploded perspective view of the vessel of FIG. 4.

With reference to FIG. 5, in the illustrated configuration, the outlet protrusion 134 terminates in a dispensing head 162. A portion of the dispensing head 162 that protrudes outwardly from the main body of the vessel 102 can have a coupling structure 164. The coupling structure 164 can have any suitable configuration keeping in mind a desire to join the dispensing assembly 150 to the vessel 102. In the illustrated configuration, the coupling structure 164 comprises threads or the like.

In the illustrated configuration, the dispensing head 162 generally closes off the opening to decrease the size of the outlet provided. In other words, the dispensing head 162 comprises a wall 166 through which is defined one or more windows 170. The windows can be closed off with frangible components or can be open upon delivery to the end user. In the illustrated configuration, however, the windows 170 are open because the product is inserted into the vessel 102 through the windows 170.

In the illustrated configuration, the wall 166 is not vertical. In other words, the wall 166 defines a plane that is at an angle relative to vertical. As illustrated in FIG. 2, the wall 166 (which is coplanar with the end of the cap 160) is substantially normal to the parting plane P. In some configurations, the wall 166 is angled slightly downward from normal relative to the parting plane P.

The ring 152 can be positioned between the wall 166 and the spout 154. The ring 152 can be formed of a lubricious material in some configurations and the ring 152 helps the spout 154 to rotate more smoothly.

The spout 154 can have one or more delivery opening 172. In the illustrated configuration, the delivery opening 172 is circumscribed by a raised chute 174. The raised chute 174 can help direct the flow of flowable product or the like. The spout 154 also can comprise ridges 176 or the like. The ridges 176 can assist with the rotation of the spout 154 relative to the vessel 102.

The spout 154 and the ring 152 can be secured in position against the wall 166 using the retaining ring 156. The retaining ring 156 can include a coupling structure 180 that interlocks with the coupling structure 164 of the dispensing head 162. In the illustrated configuration, the coupling structures 164, 180 comprise threads. The threads can be configured such that, upon tightening of the coupling structures 164, the retaining ring 156 secures the spout 154 against significant axial movement while allowing rotational movement of the spout 154 relative to the dispensing head 162. In some configurations, the retaining ring 156 can comprise a shoulder 182 that is used to capture the spout 154 and secure it against relative axial movement.

The illustrated retaining ring 156 also comprises an external shoulder 184. The cap 160 can be installed over the outer surface of the retaining ring 156. In the illustrated configuration, the external shoulder 184 limits the degree to which the cap 160 can be placed onto the retaining ring 156. Other configurations are possible keeping in mind a desire to use the cap 160 to close off any openings of the dispensing assembly 150.

Figure 6:
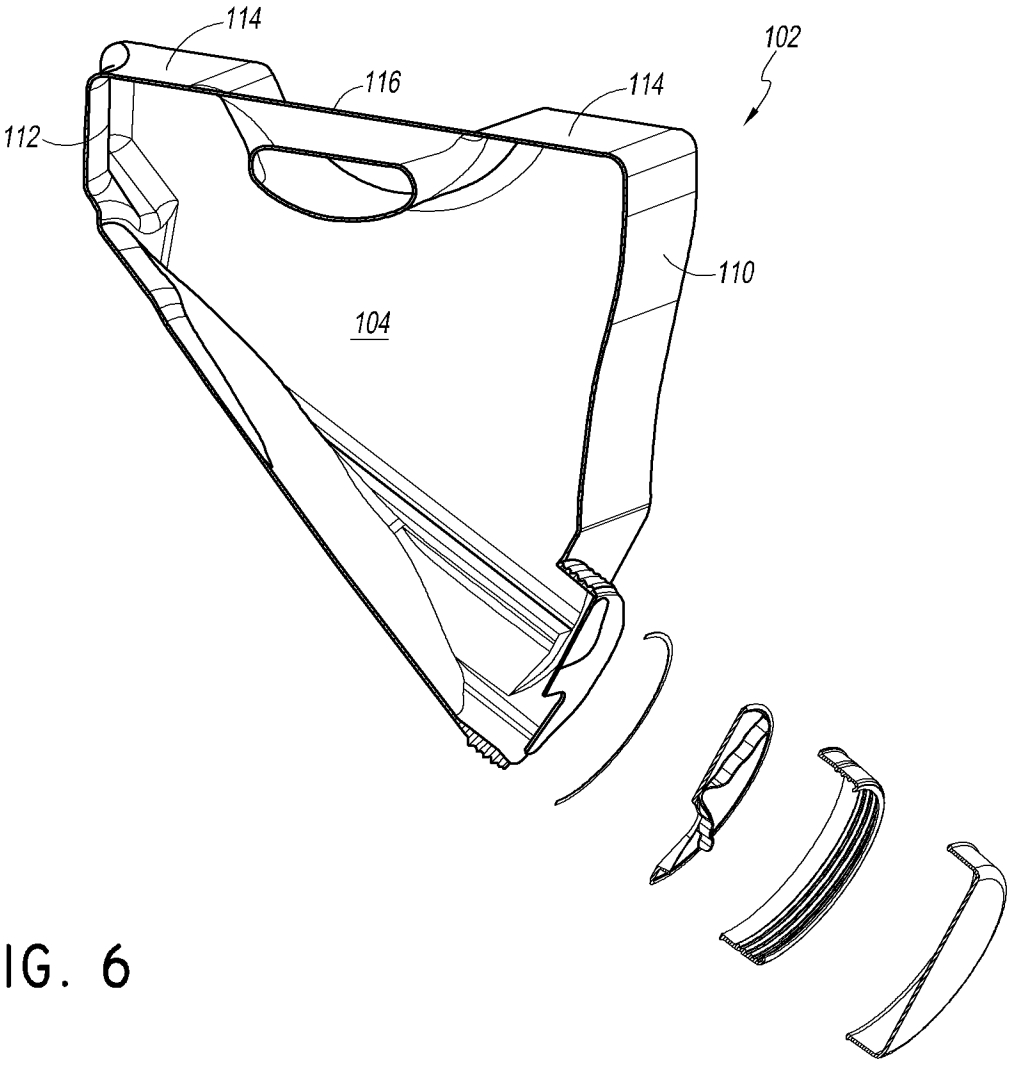
FIG. 6 is an exploded sectioned view of the vessel of FIG. 4.
Figure 7:
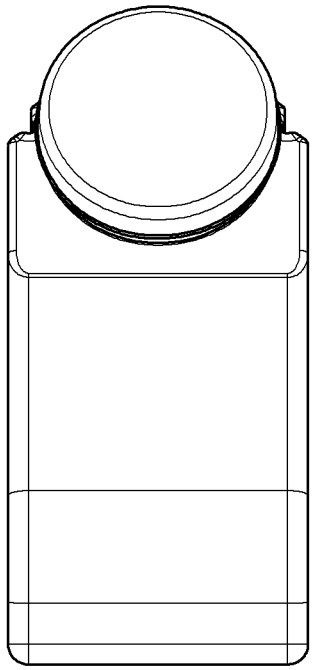
FIG. 7 is a first end view of the vessel of FIG. 4.
Figure 8:
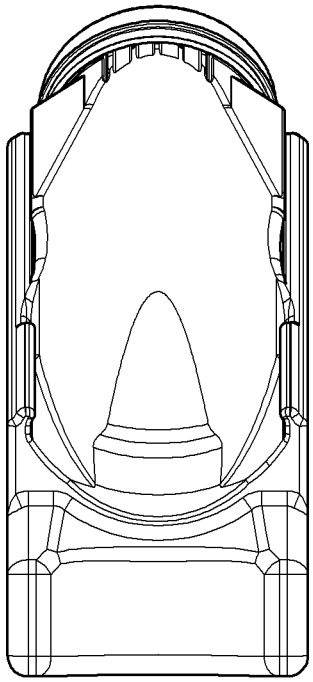
FIG. 8 is a second end view of the vessel of FIG. 4.
Figure 9:
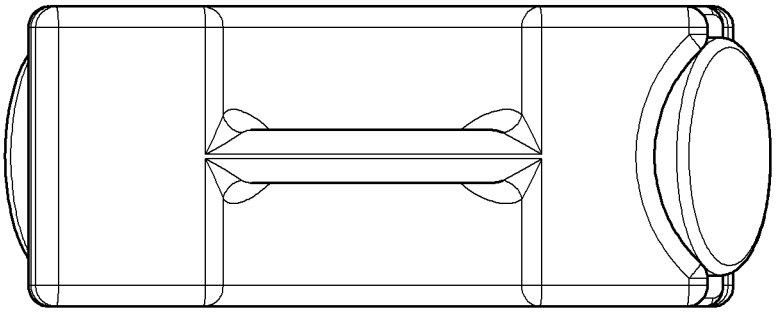
FIG. 9 is a bottom view of the vessel of FIG. 4.
Figure 10:
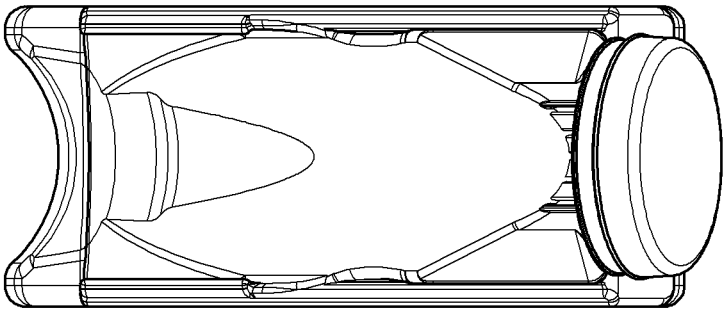
FIG. 10 is a top view of the vessel of FIG. 4.
Figure 11:
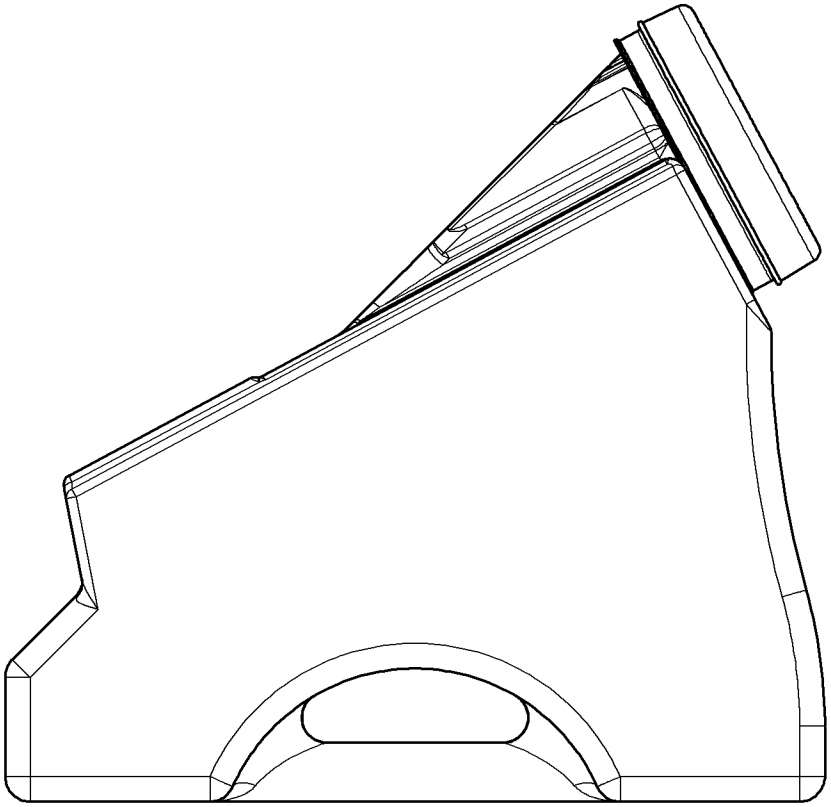
FIG. 11 is a side view of the vessel of FIG. 4 and the other side view is a mirror image of FIG. 11.

With reference to FIG. 6, the inside of the vessel 102 can be seen. As illustrated, the handle 116 can be hollow. In some configurations, the handle 116 is solid. As illustrated, the junctions between the walls that define the vessel (e.g., the side walls 104, the vertical walls 110, 112, the interconnecting wall 114, etc.) preferably are smooth transitions (i.e., have a radius) on the inside, the corners facilitate flow and decrease the likelihood of the contained product becoming wedged into the corners.

With reference to FIG. 4, in the illustrated configuration, the parting plane P defines a product flow angle. While the recess 140 and the embossment 144 vary from the parting plane, the parting plane defines the angle along with most of the product will flow to the dispensing assembly 150. In the illustrated configuration, the product flow angle A is 45 degrees. In some configurations, the product flow angle A can be between 40 degrees and 50 degrees. In some configurations, the product flow angle A can be between 30 degrees and 60 degrees. In some configurations designed specifically for fluids, the product flow angle can be less. For example, in some such liquid configurations, the product flow angle can be as low as 10 degrees. In some such liquid configurations, the product flow angle can be between 10 and 20 degrees. In some such configurations, the product flow angle can be between 5 and 25 degrees.

In some configurations, a dispensing outlet angle B is 60 degrees from vertical (i.e., the axis of the dispensing outlet relative to vertical is 60 degrees). In some configurations, the dispensing angle B is between 50 degrees and 70 degrees. In some configurations, the dispensing angle B is greater than a product flow angle A, which will be discussed below. By angling the dispensing angle B slightly more than the product flow angle A, dispensing can be conducted more efficiently with an easier flow and less spillage.

Use of the Container System

Each of the vessels 102 stores some type of product. In the illustrated configuration, there are two vessels 102. In other configurations, more than two vessels 102 can be used. The vessels 102 each include the outlet, which can include the dispensing assembly 150. The outlet in the illustrated configuration includes the chute 174. The chute 174 can be rotated to reveal the opening through which the product can be dispensed. The chute 174 can be manipulated to stop any further dispensing.

In the illustrated configuration, each of the outlets is sealed by the seal and closed off by the cap 160. In this manner, the outlets can be sealed, covered and encapsulated prior to being opened for dispensing through the outlet. In some configurations, the cap 160 and the vessel 102 has been designed such that the cap 160 can be quickly and easily removed and replaced.

As discussed above, the vessels 102 are removably connected. In the illustrated configuration, the vessels 102 can be connected using the interlocking structures 124. In some configurations, adhesive or the like can be used to secure the vessels 102 in position relative to each other.

Once the vessels 102 have been interconnected, the interior product ramp is formed due to the configuration of the container system 100. In the illustrated configuration, the lower wall of the vessel 102 forms the interior product ramp. With the upper vessel 102 supported by the lower vessel 102, the lower sloping wall of the upper vessel 102 defines the interior product ramp that enables the product to dispense in a flowing, gravity-fed fashion. Each vessel 102 is configured to dispense the product contained therein when it is the upper vessel 102. In some configurations, each vessel 102 is configured to only dispense the product therein when it is the upper vessel 102.

In some configurations, the container system 100 is used as packaging for dry product. Once the vessels 102 have received the product, the vessels 102 can be sealed. The container system 100 then is used to transport the product with minimal to no loss or waste prior to sale of the container system 100 with product contained therein. By using the container system, as compared to bagged packaging, it is possible to contain more volume of product per linear shelf length. In addition, by using the container system, as compared to bagged packaging, it is possible to contain more volume of product per shipping pallet.

Once the end user has the container system, the seal may be broken and the product contained within each of the vessels 102 can be effortlessly, tidily and efficiently dispensed. The end user (e.g., consumer) benefits from the container system 100 in many ways. The handle 116 of the illustrated configuration is designed with ergonomics in mind. The handle 116 is sized, configured and positioned to aid in lifting, loading and transporting the product contained within the container system 100 from the store shelf, to the store cart, to the end user's vehicle and ultimately to the shelf of the end user. There is minimal product lost due to flimsy packaging. In addition, a simple manipulation initiates dispensing of the product while another simple manipulation can stop dispensing of the product. Furthermore, one of the portions of the container system 100 remains sealed while the other is unsealed and used for dispensing.

For purposes of this disclosure, certain aspects, advantages, and novel features are described herein. Not necessarily all such advantages may be achieved in accordance with any particular embodiment. Thus, for example, those skilled in the art will recognize that the disclosure may be embodied or carried out in a manner that achieves one advantage or a group of advantages as taught herein without necessarily achieving other advantages as may be taught or suggested herein.

Unless the context clearly requires otherwise, throughout the description and the claims, the words "comprise", "comprising", and the like, are to be construed in an inclusive sense as opposed to an exclusive or exhaustive sense, that is to say, in the sense of "including, but not limited to".

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments or that one or more embodiments necessarily include these features, elements and/or states.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require the presence of at least one of X, at least one of Y, and at least one of Z.

Language of degree used herein, such as the terms "approximately," "about," "generally," and "substantially" as used herein represent a value, amount, or characteristic close to the stated value, amount, or characteristic that still performs a desired function or achieves a desired result. For example, the terms "approximately", "about", "generally," and "substantially" may refer to an amount that is within less than 10% of, within less than 5% of, within less than 1% of, within less than 0.1% of, and within less than 0.01% of the stated amount. As another example, in certain embodiments, the terms "generally parallel" and "substantially parallel" refer to a value, amount, or characteristic that departs from exactly parallel by less than or equal to 15 degrees, 10 degrees, 5 degrees, 3 degrees, 1 degree, 0.1 degree, or otherwise.

The scope of the present disclosure is not intended to be limited by the specific disclosures of preferred embodiments in this section or elsewhere in this specification, and may be defined by claims as presented in this section or elsewhere in this specification or as presented in the future. The language of the claims is to be interpreted broadly based on the language employed in the claims and not limited to the examples described in the present specification or during the prosecution of the application, which examples are to be construed as non-exclusive.

It should be noted that various changes and modifications to the presently preferred embodiments described herein will be apparent to those skilled in the art. Such changes and modifications may be made without departing from the spirit and scope of the invention and without diminishing its attendant advantages. For instance, various components may be repositioned as desired. It is therefore intended that such changes and modifications be included within the scope of the invention. Moreover, not all of the features, aspects and advantages are necessarily required to practice the present invention. Accordingly, the scope of the present invention is intended to be defined only by the claims.

What is claimed is:

1. A container system comprising a plurality of vessels that are connectable together:

each of the vessels defining a separately sealed volume, each of the vessels comprising an outlet, one of the plurality of vessels being an upper vessel and one of the plurality of vessels being a lower vessel, the upper vessel and the lower vessel being connected together using an adhesive such that the upper vessel and the lower vessel are secured together to resist separation, the upper vessel and the lower vessel being connected together using mating interlocking structures, the mating interlocking structures comprising a slide portion that extends axially along only a portion of an outer surface of the outlet protrusion and a rail portion with the rail portion being received within the slide portion, the rail portion being defined by an embossment formed on a lip of an outlet receiving recess:

the outlet of the upper vessel being the lowermost portion of the upper vessel and being disposed to one side of the upper vessel, the outlet of the lower vessel being the uppermost portion of the lower vessel and being disposed to one side of the lower vessel, and the uppermost portion of the upper vessel being positioned higher than the uppermost portion of the lower vessel.

2. The container system of claim 1, wherein the outlet of the upper vessel is recessed inward relative to the one side of the upper vessel.

3. The container system of claim 2, wherein the outlet of the upper vessel projects further laterally outward relative an adjacent side of the lower vessel.

4. The container system of claim 1, wherein the upper vessel comprises a non-horizontal lower surface that defines a dispensing angle that is greater than a product flow angle when the upper vessel is supported by the lower vessel and the lower vessel is resting on a horizontal surface.

5. The container system of claim 4, wherein the dispensing angle is 60 degrees and the product flow angle is 45 degrees.

6. The container system of claim 1, wherein the upper vessel comprises both an outlet protrusion and an outlet receiving recess and the lower vessel comprises both an outlet protrusion and an outlet receiving recess.

7. The container system of claim 6, wherein the outlet protrusion of the upper vessel is received within the outlet receiving recess of the lower vessel and the outlet protrusion of the lower vessel is received within the outlet receiving recess of the upper vessel when the upper vessel and the lower vessel are connected together.

8. The container system of claim 1, wherein each of the upper vessel and the lower vessel comprises a handle that is positioned on an uppermost surface of the upper vessel and the lowermost surface of the lower vessel.

9. The container system of claim 1, wherein the outlet of the upper vessel comprises a dispensing assembly and the outlet of the lower vessel comprises a dispensing assembly with each of the dispensing assemblies comprising a removable cap.

10. The container system of claim 1, wherein the upper vessel and the lower vessel have identical constructions.

11. The container system of claim 1, wherein the upper vessel and the lower vessel are configured to have the same contained volumes.

12. A container system comprising two identical interlocked vessels, each of the two vessels defining a separately sealed volume, each of the two vessels comprising a pair of generally triangular side walls, the pair of generally triangular side walls being generally parallel to each other, the pair of generally triangular side walls being joined together by a first generally vertical end wall and a second generally vertical end wall, the first generally vertical end wall being longer than the second generally vertical end wall, the second generally vertical end wall defining a vertically extending recess, the vertically extending recess having a shape of a partial cylinder, the pair of generally triangular side walls being connected by an interconnecting wall, the interconnecting wall comprising a first portion and a second portion that are connected by a handle portion, the interconnecting wall defining an upper wall and a lower wall of the container system when the two identical interlocked vessels are secured together, an outlet defined at a base of the first generally vertical end wall, the outlet extending downwardly and outwardly relative to the interconnecting wall such that, when the two identical interlocked vessels are connected, the outlet is positioned above the vertically extending recess at a non-parallel angle, a parting plane extending at a non-ninety degree angle relative to the interconnecting wall and defining a plane along which the two identical interlocked vessels connect, and the outlet having at least a portion that is intersected by the parting plane when the outlet is in a closed position.

13. A container system comprising a plurality of vessels that are connectable together:

one of the plurality of the vessels being an upper vessel and one of the plurality of vessels being a lower vessel;

each of the vessels defining a separately sealed volume, each of the vessels comprising a pair of parallel side walls and an outlet positioned between planes defined by the pair of parallel side walls, the pair of parallel side walls being connected by a plurality of peripheral walls, a short peripheral wall being positioned to a first end of the pair of parallel side walls and a long peripheral wall being positioned to a second end of the pair of parallel side walls, the short peripheral wall defining a vertically extending recess, the vertically extending recess having a shape of a partial cylinder, an interconnecting wall connecting the short peripheral wall to the long peripheral wall, the interconnecting wall comprising a first portion and a second portion that are connected by a handle portion, the interconnecting wall defining an upper wall and a lower wall of the container system when the two identical interlocked vessels are secured together, the outlet being adjacent to the long peripheral wall;

the outlet of the upper vessel being the lowermost portion of the upper vessel, and the outlet of the lower vessel being the uppermost portion of the lower vessel, the outlet of the upper vessel projecting further laterally outward relative to the adjacent side wall of the lower vessel with the upper vessel mounted on the lower vessel, and the uppermost portion of the upper vessel being positioned higher than the uppermost portion of the lower vessel.

14. The container system of claim 13, wherein the outlet extends downwardly and outwardly relative to the interconnecting wall such that, when the two identical interlocked vessels are connected, the outlet is positioned above the vertically extending recess at a non-parallel angle.

15. The container system of claim 14, wherein a parting plane extends at a non-ninety degree angle relative to the interconnecting wall and defines a plane along which the two identical interlocked vessels connect, and the outlet having at least a portion that is intersected by the parting plane when the outlet is in a closed position.

16. The container system of claim 15, wherein the upper vessel and the lower vessel are connected together using an adhesive such that the upper vessel and the lower vessel are secured together to resist separation.

17. The container system of claim 12, wherein wherein the outlet of the upper vessel projects further laterally outward relative an adjacent side of the lower vessel.

18. The container system of claim 12, wherein the upper vessel comprises a non-horizontal lower surface that defines a dispensing angle that is greater than a product flow angle when the upper vessel is supported by the lower vessel and the lower vessel is resting on a horizontal surface.

19. The container system of claim 18, wherein the dispensing angle is 60 degrees and the product flow angle is 45 degrees.

20. The container system of claim 12, wherein the outlet of the upper vessel comprises a dispensing assembly and the outlet of the lower vessel comprises a dispensing assembly with each of the dispensing assemblies comprising a removable cap.

* * * * *